United States Patent [19]

Luigi

[11] Patent Number: 5,042,273

[45] Date of Patent: Aug. 27, 1991

[54] CONTROL DEVICE FOR PLUNGER NEEDLES IN CROCHET GALLOON MACHINES

[75] Inventor: Omodeo Z. Luigi, Cilavegna-Pavia, Italy

[73] Assignee: Comez, S.P.A., Pavia, Italy

[21] Appl. No.: 545,990

[22] Filed: Jun. 28, 1990

[30] Foreign Application Priority Data

Dec. 20, 1989 [IT] Italy ..... 22761 A/89

[51] Int. Cl.[5] ..... D04B 27/08

[52] U.S. Cl. ..... 66/208

[58] Field of Search ..... 66/84 R, 120, 204, 208

[56] References Cited

FOREIGN PATENT DOCUMENTS 1007507 2/1952 France ..... 66/84 R 25894 9/1963 German Democratic Rep. ... 66/208

*Primary Examiner*—Wm. Carter Reynolds

*Attorney, Agent, or Firm*—Laff, Whitesel, Conte & Saret

[57] ABSTRACT

In a crochet galloon machine, the needles (11) are fastened to a needle bar (12) reciprocated by at least a connecting rod (20) for the control of needles, operatively engaged with a needle control eccentric (21) carried by the rotary main shaft (22). Associated with the needles (11) are closure latches (13) fastened to a thrust bar (14) integral with at least a rod (18) carrying out a reciprocating movement upon command of a rocker lever (29) the opposite ends of which are fastened to respective connecting rods (30) for the control of latches (13). Each connecting rod (30) is driven by a latch control eccentric (31) operated by the main shaft (22).

6 Claims, 2 Drawing Sheets

CONTROL DEVICE FOR PLUNGER NEEDLES IN CROCHET GALLOON MACHINES

BACKGROUND OF THE INVENTION

1. Field of the Invention

The present invention relates to a control device for "plunger needles" in crochet galloon machines, of the type comprising: a needle bar oscillatably connected to the bed of a crochet galloon machine and fixedly engaging the rear ends of a plurality of needles disposed parallelly in side-by-side relation one following the other; at least a connecting rod for the needle control, the front end of which is operatively connected to the needle bar; a main shaft rotatably supported by the machine bed and carrying at least an eccentric for the needle control, operatively engaged to the rear end of the needle control connecting rod to impart the needles a reciprocating motion in the longitudinal direction; a thrust bar oscillatably connected to the machine bed and engaging the rear ends of a plurality of closure latches each slidably guided over one of said needles; a driving mechanism for the control of the closure latches which is operated by the main shaft and acts upon the thrust bar to impart a reciprocating motion in the longitudinal direction to the closure latches in synchronism with the needle movements.

2. Prior Art

It is known that there are crochet galloon machines provided with the so-called "plunger needles" which, slidably supported by a front grooved bar in side-by-side relation, cooperate with other members, such as for example eye-pointed needles for the warp yarns and tubular guides for the weft yarns, to produce a manufactured article by interlacing weft yarns with warp yarns.

Plunger needles consist each of two separate portions. In greater detail, each plunger needle comprises a true needle, exhibiting a hook-shaped front end projecting in cantilevered fashion from the front grooved bar, and a so-called closure latch, also referred to as "plunger" by those skilled in the art, which appears in an overlaid position with respect to the needle and is guided lengthwise over the same.

When the needles fixedly carried by a needle bar are being operated, they receive a reciprocating motion in a substantially longitudinal direction. Meanwhile the closure latches, carried by a so-called thrust bar, are reciprocated in a longitudinal direction too in synchronism with the needle movements. In greater detail, the movement of the closure latches enables each of them to be moved relative to the needle from a closure condition in which the front end of the latch closes the round bend formed by the hooked end of the needle, to an opened condition in which the latch is disposed in a backward position on the needle to open the yarn passage to said round bend.

The synchronized operation of the needles and closure latches takes place by means of suitable control devices receiving the movement from cams and/or eccentrics carried by a main shaft driven in rotation.

In greater detail, in the known control devices the needle bar and thrust bar are provided to be mutually superposed and fastened, each by its respective opposite ends, to a pair of rods slidably guided with respect to the machine bed. Connected to each rod is a pair of rollers acting by contact, on diametrically opposite sides, upon the profile of a respective cam carried by a main shaft operable in rotation. The cam is so shaped that by acting on the respective rollers it causes both the going and return strokes of the corresponding needle bar or thrust bar.

While the devices of this type have proved to be satisfactory in operation, it has been ascertained that above all when high speeds are concerned, the big masses involved can easily give rise to an early wear of the cam followers and/or profiles as a result of a prolonged use of the machine.

In addition these devices do not allow an easy adaptability of the crochet galloon machine to the execution of workings of different types. It is to be pointed out in the connection that, in operation, the closure latches must carry out temporary stops when they reverse their reciprocating motion. These temporary stops need to be more or less long depending upon the type of working which is being performed. Since the movements of the latches are directly correlated to the cam profile controlling the movements of the thrust bar, it results that it is necessary to replace the cam when the device must carry out a working different from the preceding one. This requirement gives rise to problems not only as regards the time necessary for replacing the cam but also because different types of cams adapted to perform the different workings need to be kept in stock.

SUMMARY OF THE INVENTION

The main object of the present invention is substantially to solve the problems of the known art by providing a control device adapted to run with great reliability even at speeds much higher than those achievable with the current crochet galloon machines which at the same time allows the movements of the thrust bar to be modified in a very simple fashion so that it will be able to fit the execution of different workings.

The foregoing and further objects which will become more apparent in the course of the present description are substantially attained by a control device for plunger needles in crochet galloon machines, wherein said driving mechanism controlling the movement of the closure latches comprises at least a rod slidably guided within the machine bed, fixedly connected to the thrust bar and movable according to the direction of the longitudinal extension of the needles and closure latches; at least a rocker lever having its fulcrum on the rear end of the rod; at least a pair of connecting rods for the latch control, having their respective front ends engaged with the opposite ends of the rocker lever; at least a pair of eccentrics for the latch control, operable by the main shaft and operatively engaging the rear ends of the latch control connecting rods.

BRIEF DESCRIPTION OF THE DRAWINGS

Further features and advantages will best be understood form the detailed description of a preferred embodiment of a control device for plunger needles in crochet galloon machines in accordance with the present invention, given hereinafter by way on non-limiting example with reference to the accompanying drawings in which.

DESCRIPTION OF THE PREFERRED EMBODIMENT

Figure 1:
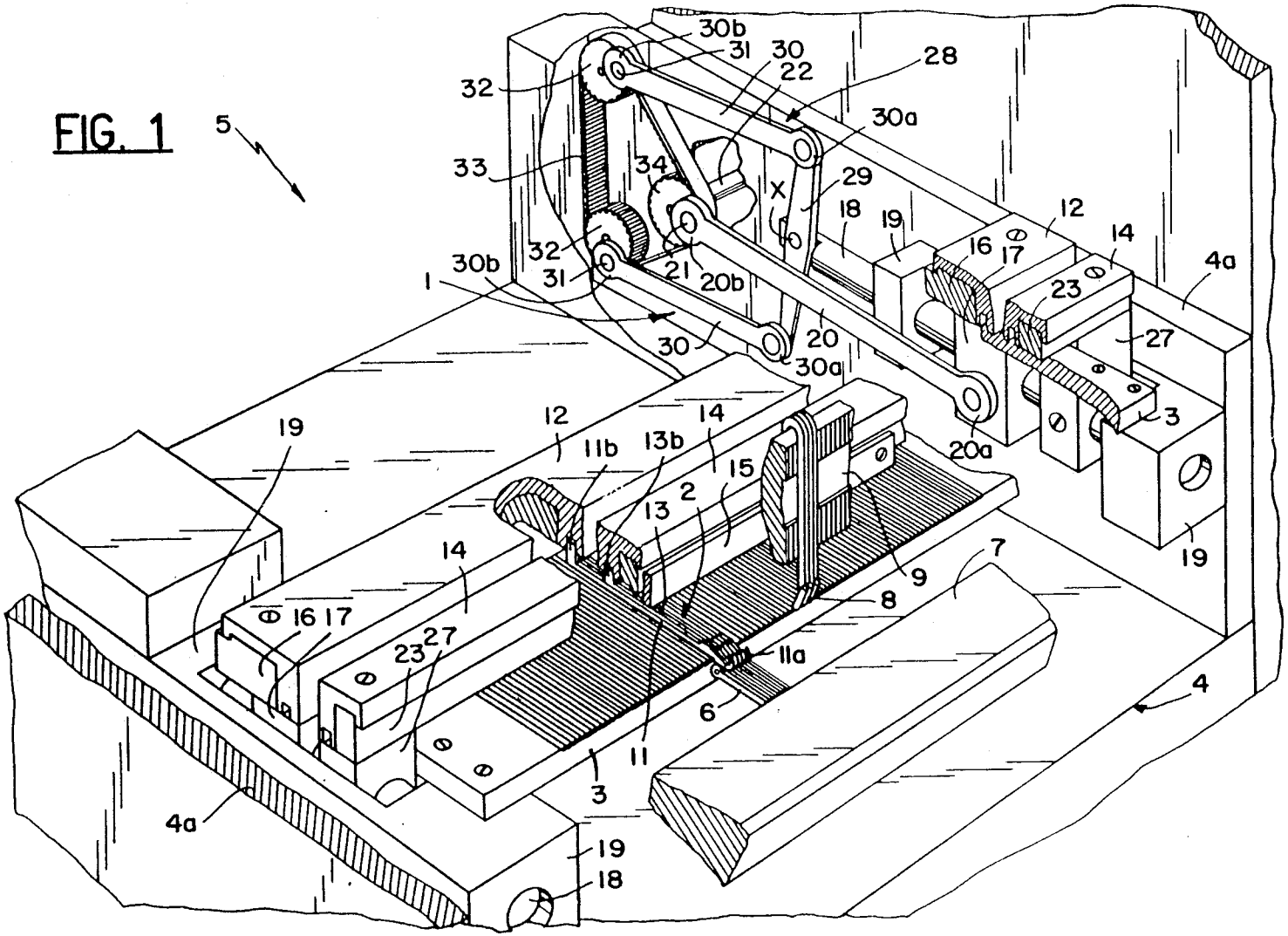
FIG. 1 diagrammatically shows in a fragmentary perspective view, the control device in accordance with the present invention mounted on a crochet galloon machine.

With reference to the accompanying drawings, a control device for plunger needles in crochet galloon machines in accordance with the present invention has been generally identified by reference numeral 1.

Referring particularly to FIG. 1 the control device 1 is arranged so that it suitably operates a plurality of plunger needles 2 slidably supported by a front grooved bar 3 which is fastened to the opposite posts 4*a* of a machine bed 4 being part of a conventional crochet galloon machine generally identified at 5.

In a manner known per se, the plunger needles 2 cooperate, within the general operation of the crochet galloon machine 5, with a plurality of eye-pointed needles 6 carried by a yarn guide bar 7 driving them in an oscillatory movement, as well as with a plurality of tubular yarn guides 8 carried by one or more tubular guide carriers 9. The eye-pointed needles 6 engage respective warp yarns 6*a* (FIGS. 2-5), whereas the tubular yarn guides 8 engage respective weft yarns, not shown.

The device 1 is so arranged that it imparts a suitable reciprocating motion to the plunger needles 2 to enable them to cooperate with the eye-pointed needles 6 and the tubular weft yarn guides 8 also reciprocated in a manner known per se and therefore not described, in order to produce a manufactured article 10 (FIGS. 2-5) by suitably interlacing the warp yarns 6*a*.

In greater detail, each plunger needle 2 is substantially comprised of a true needle referenced by 11 having a hook-shaped front end 11*a* and the rear end 11*b* of which is operatively engaged with a needle bar 12.

Longitudinally running over the needle 11 is a closure latch 13 the front end 13*a* of which has a tapered configuration and the rear end 13*b* of which is operatively engaged by a thrust bar 14. A stop bar 15 (FIG. 1) fastened to the front of the thrust bar 14 prevents the plunger needles 2 from raising from the front grooved bar 3. Preferably the needle bar 12 and thrust bar 14 are disposed one behind the other in substantially coplanar relation.

The needle bar 12 is fastened to one crosspiece 16 the opposite ends of which are made integral with two first blocks 17 slidably guided along respective rods 18. Rods 18 substantially extend according to the longitudinal extension direction of the plunger needles 2 and are slidably supported by respective guide blocks 19 fastened to the bed posts 4*a*, for the purposes to be described later.

The needle bar 12 is operatively connected to a pair of connecting rods 20 for the control of the needles (only one of which is shown) each exhibiting a front end 20*a* linked to one of the first blocks 17 and a rear end 20*b* operatively engaged with an eccentric 21 for the control of the needles carried by the main shaft 22 driven in rotation by a motor not shown which is housed in the machine bed 4.

The thrust bar 14 is in turn secured to a second crosspiece 23 the opposite ends of which are made integral with two second blocks 27 fastened to said rods 18. Each rod 18 is acted upon by a driving mechanism controlling the movement of the closure latches generally identified by 28 which mechanism is operated by the main shaft 22 so as to impart a reciprocating lengthwise movement to the closure latches 13 through the thrust bar 14, in synchronism with the movements carried out by the needles 11 upon the action of the connecting rods 20.

The driving mechanism 28 for the control of the closure latches originally provides that a rocker lever 29 should be supported and have its fulcrum on each of the rods 18, at a location referenced by X; linked to the opposite ends of said rocker lever are the front ends 30*a* of a pair of connecting rods 30 for the control of latches, which ends are spaced apart by the same distance from the pivoting point of lever 29 on rod 18.

The connecting rods 30 have each a rear end 30*b* operatively engaged on an eccentric 31 for the control of latches, operable upon command of the main shaft 22. In greater detail, preferably each latch control eccentric 31 should be mounted on a toothed pulley 32 rotatably connected to the corresponding bed post 4*a*.

A toothed driving belt 33 operatively meshes with the toothed pulleys 32 and with a drive pulley 34 keyed on the main shaft 22 to transmit the rotatory movement of the main shaft 22 to the latch control eccentrics 31 so that the gear ration is 1:1.

The toothed pulleys 32 are preferably spaced apart by the same distance from the axis of rotation of the main shaft 22.

OPERATION

Operation of the device according to the invention described above mainly as regards structure, is as follows.

When the device 1 is operated, needles 11 carry out a substantially rectilinear reciprocating movement. Simultaneously also latches 13 are operated and carry out a substantially rectilinear movement in synchronism with the movements of the needles. However latches 13, unlike needles 11, are subjected to perform temporary stops when they reverse their reciprocating movement. In an original manner, the duration of time of these temporary stops is given by the mutual out of phase shifting of the latch control eccentrics 31 with respect to the axes of the corresponding toothed pulleys 32. In the example shown in the figures the latch control eccentrics are mutually out of phase shifted by 90°.

FIGS. 2 to 5 show different operating steps following each other as a result of the angular clockwise rotations through 90° of the main shaft 22 and the latch control eccentrics 31 about the respective axes of rotation. For the sake of clearness and simplicity the tubular guide carriers 8 have not been shown in the drawings.

Figure 2:
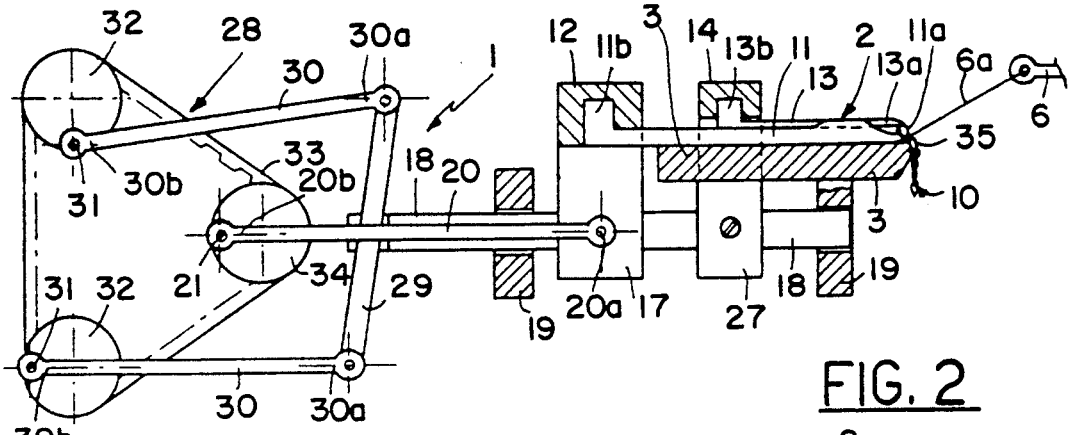
FIG. 2 is a diagrammatic side view showing the device in question in one operating step.

FIG. 2 shows the device in an initial step of a stitch forming process. In this step each of the needles 11 and the corresponding closure latch 13 are backwardly positioned on the front grooved bar 3. In this situation the plunger needle 2 releases the stitch previously formed around the needle itself. The eyelet formed by this stitch, referenced by 35, interloops the yarn 6*a* coming from the corresponding eye-pointed needle 6 which yarn had been previously engaged around the hooked end 11*a* of needle 11.

Figure 3:
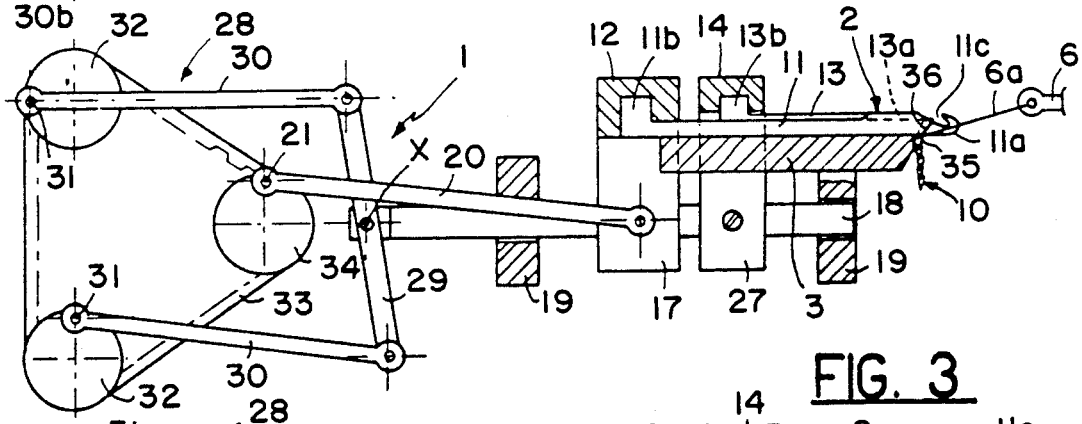
FIG. 3 is a side view of the device in an operating step following the one shown in FIG. 2.

Following the rotation through 90° of the main shaft 22, the device 1 brings each plunger needle 2 to the condition shown in FIG. 3. As can be seen from said figure, the needle 11 has moved towards the eye-pointed needle 6, whereas the corresponding closure latch 13 has kept stationary. This is due to the fact that the movements of the latch control connecting rods 30 by the respective eccentrics 31 has occurred so as to produce an angular oscillation of the rocker lever 29 about its pivoting point X on rod 18. The progress of needle 11 relative to the closure latch 13 establishes the opening of the round bend 11*c* defined by the hook-shaped front end 11*a* of the needle itself. Simultaneously the eyelet 36 formed by yarn 6*a* around the front end 11*a* of the needle 11 rises towards the upper edge of the needle.

Figure 4:
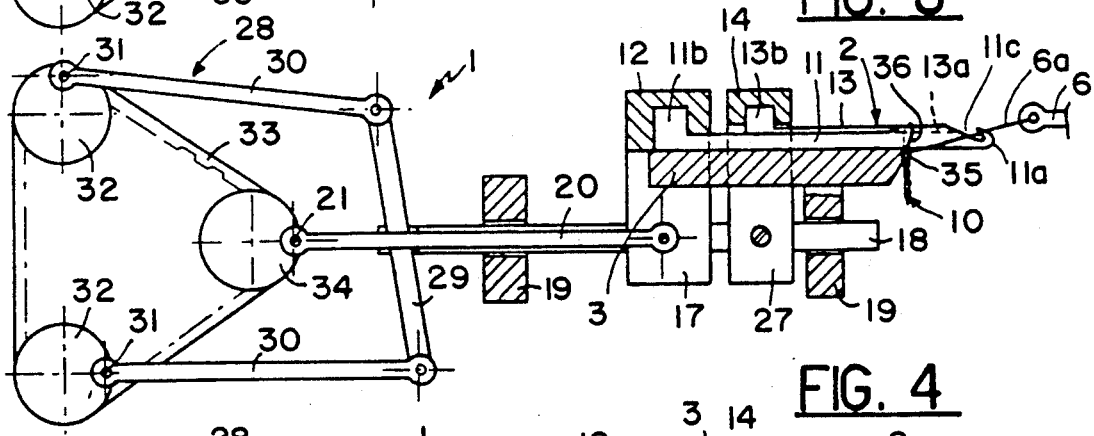
FIG. 4 shows the inventive device in a third operating step.

Shown in FIG. 4 is an operating step following the one shown in FIG. 3 in which the needle 11 has come close to the end of its stroke towards the eye-pointed needle 6 and has been followed in its movement by the closure latch 13. While passing from the operating condition shown in FIG. 3 to the one shown in FIG. 4, the positioning of the closure latch 13 relative to the needle 11 has not substantially changed. In the condition shown in FIG. 4 the eyelet 36 formed by yarn 6*a* has been loaded on the upper edge of the plunger needle 2 and the hook-shaped front end 11*a* is ready to engage again the yarn 6*a* carried by the eye-pointed needle 6.

Figure 5:
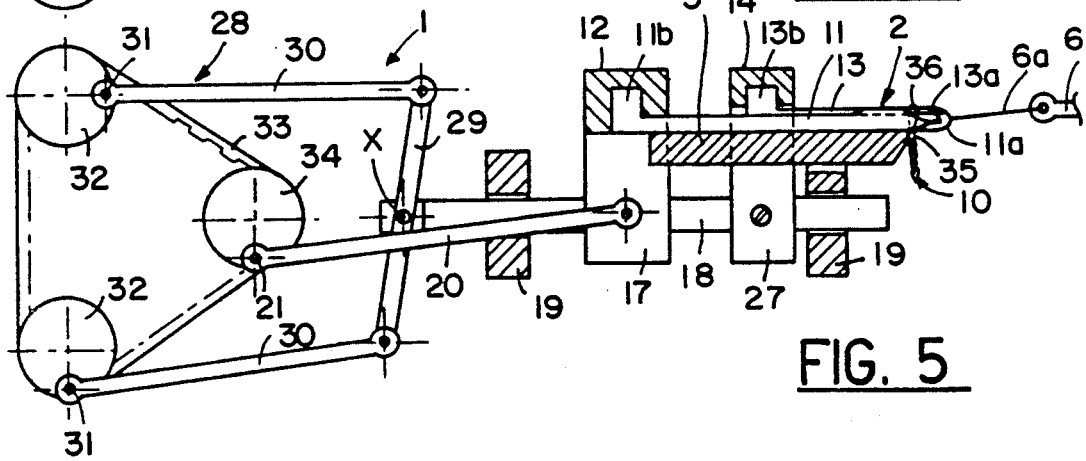
FIG. 5 is a side view of an operating step following the one shown in FIG. 4.

A further rotation through 90° of the main shaft 22 brings to the operating condition shown in FIG. 5. It can be noted that now needle 11 has moved backward relative to its position in FIG. 4, whereas the closure latch 13 has kept stationary and therefore closes the passage to the round bend 11*c*. In this case too the lack of movement of latch 13 is due to the fact that the movement of the latch control connecting rods 30 takes place so as to produce an angular oscillation of the rocker lever 29 about point X, without any axial displacement of rod 18.

The stitch forming operating cycle is completed with the passage from the operating condition shown in FIG. 5 to the one shown in FIG. 1. By said passage the needle 11 and latch 13 move backward on the front grooved bar 3 so that the new stitch formed by the eyelet 36 is subjected to slide on the front end 13*a* of latch 13 and will be unloaded from the plunger needle 2, while yarn 6 will form a new eyelet about the hook-shaped front end 11*a* of needle 11.

Advantageously the duration of the temporary stops in the latch movements while passing from the operating steps shown in FIGS. 2 and 4 to those shown in FIGS. 3 and 5 can be easily adjusted by modifying the out of phase shifting of the latch control eccentrics 31. For this operation only the disengagement of the toothed belt 33 from at least one of the pulleys 32 is required together with the appropriate mutual angular orientation of the pulleys themselves.

In greater detail, the duration of the temporary stops of latches 13 increases proportionally as the angle of the out of phase shifting of the eccentrics 31 increases. The boundary cases for this adjustment are represented by a condition in which the eccentrics 31 are in phase, that is shifted through 0°, and a condition in which the eccentrics are out of phase through 180°.

When the eccentrics 31 are in phase the duration of the temporary stops is substantially zero, as the rocker lever 29 is never subjected to rotate about its pivot axis on the rod 18 and the movements of the connecting rods 30 are integrally transmitted to the rod itself.

On the contrary, when the eccentrics 31 are out of phase through 180°, the closure latches 13 are practically stationary, as the movement of the connecting rods 30 is completely absorbed by the angular rotations of the rocker lever 29 about its pivot axis on the rod 18.

In pratical use the angle of the out of phase shifting of the eccentrics 31 is preferably in the range of 45° to 135°.

The present invention attains the intended purposes.

In fact the inventive device is capable of controlling the going and return strokes of the needles and the closure latches without the aid of cams and followers but by the use of eccentrics only. As a result the device will be of very simple construction and reliable in use and will enable the accomplishment of operative speeds higher than those which can be reached in the known art.

In addition, as previously proved, the device allows the duration of the temporary stops of the closure latches to be modified without the replacement of any construction detail being needed.

Therefore, making a comparison with the known art, it is no longer necessary to produce a great number of cams having different profiles to be used depending upon the type of working that the crochet galloon machine must carry out, and all problems concerned with the replacement of the cams on the machines already arranged to execute a given working are eliminated.

Obviously the present invention is susceptible of many modifications and variations, all falling within the scope of the invention idea characterizing it.

What is claimed is:

1. A control device for plunger needles in crochet galloon machines, comprising:

a needle-bar oscillatably connected to the bed of a crochet galloon machine and fixedly engaging the rear ends of a plurality of needles disposed parallelly in side-by-side relation one following the other;

at least a connecting rod for the needle control, the front end of which is operatively connected to the needle-bar;

a main shaft rotatably supported by the machine bed and carrying at least an eccentric for the needle control, operatively engaged to the rear end of the needle control connecting rod to impart the needles a reciprocating motion in the longitudinal direction;

a thrust bar oscillatably connected to the machine bed and engaging the rear ends of a plurality of closure latches each slidably guided over one of said needles;

a driving mechanism for the control of the closure latches which is operated by the main shaft and acts upon the thrust bar to impart a reciprocating motion in the longitudinal direction to the closure latches in synchronism with the needle movements, wherein said driving mechanism controlling the movement of the closure latches comprises:

at least a rod slidably guided within the machine bed, fixedly connected to the thrust bar and movable according to the direction of the longitudinal extension of the needles and closure latches;

at least a rocker lever having its fulcrum on the rear end of said rod;

at least a pair of connecting rods for the closure latch control, having their respective front ends engaged with the opposite ends of the rocker lever;

at least a pair of eccentrics for the latch control, operable by the main shaft and operatively engaging the rear ends of the latch control connecting rods.

2. A device according to claim 1, characterized in that said latch control eccentrics are mounted on respective pulleys rotatably supported by the machine bed according to axes of rotation spaced apart by the same distance from the main shaft, said pulleys being operable by a toothed driving belt operatively engaged with a main pulley keyed on the main shaft.

3. A device according to claim 1, characterized in that the latch control connecting rods are pivoted on the rocker lever at points spaced apart by the same distance from the pivot axis of the rocker lever on said rod.

4. A device according to claim 1, characterized in that said latch control eccentrics are mutually out of phase shifted according to an angle comprised between 45° and 135° relative to the axes of the corresponding toothed pulleys.

5. A device according to claim 1, characterized in that said needle bar is fixedly connected to at least a block slidably engaged along said rod.

6. A device according to claim 1, characterized in that said needle bar and thrust bar are disposed one behind the other in coplanar relation.

* * * * *

UNITED STATES PATENT AND TRADEMARK OFFICE

CERTIFICATE OF CORRECTION

PATENT NO. : 5,042,273

DATED : August 27, 1991

INVENTOR(S) : Luigi Omodeo Zorini

It is certified that error appears in the above-identified patent and that said Letters Patent is hereby corrected as shown below:

On the Title page, Item [19] and [75], should be Luigi Omodeo Zorini--.

Signed and Sealed this

Twenty-third Day of February, 1993

*Attest:*

STEPHEN G. KUNIN

*Attesting Officer*

*Acting Commissioner of Patents and Trademarks*